US010010474B2

(12) United States Patent
Wang

(10) Patent No.: US 10,010,474 B2
(45) Date of Patent: Jul. 3, 2018

(54) FOREARM CRUTCH

(71) Applicant: Yeagle Development Co., Ltd., New Taipei (TW)

(72) Inventor: Tsung-Hsiang Wang, New Taipei (TW)

(73) Assignee: Yeagle Development Co., Ltd., New Taipei (TW)

( * ) Notice: Subject to any disclaimer, the term of this patent is extended or adjusted under 35 U.S.C. 154(b) by 0 days.

(21) Appl. No.: 15/483,192

(22) Filed: Apr. 10, 2017

(65) Prior Publication Data

US 2017/0319422 A1 Nov. 9, 2017

(30) Foreign Application Priority Data

May 6, 2016 (CN) ..... 2016 2 0406973 U

(51) Int. Cl.
*A61H 3/02* (2006.01)
*A45B 3/00* (2006.01)

(52) U.S. Cl.
CPC ..... *A61H 3/02* (2013.01); *A45B 3/00* (2013.01); *A61H 2003/0238* (2013.01); *A61H 2201/0161* (2013.01); *A61H 2201/0192* (2013.01); *A61H 2201/1635* (2013.01)

(58) Field of Classification Search
CPC .... A61H 3/02; A61H 3/00; A61H 2003/0238; A61H 2003/0233; A61H 2003/0227; A61H 2201/0161; A61H 2003/006; A45B 3/00; A45B 2009/007; A45B 2200/055; A45B 3/12; A45B 9/02
USPC ..... 135/65–66, 68–69, 71–76
See application file for complete search history.

(56) References Cited

U.S. PATENT DOCUMENTS 2,711,183 A * 6/1955 Lofstrand, Jr. ..... A61H 3/02 135/69
3,947,140 A * 3/1976 Thomas ..... A61H 3/02 135/69
4,151,853 A * 5/1979 Inbar ..... A61H 3/02 135/69
4,846,203 A * 7/1989 Tappel ..... A61H 3/02 135/69
4,917,126 A * 4/1990 Ellmore ..... A61H 3/02 135/69

(Continued)

FOREIGN PATENT DOCUMENTS

JP 2007014613 A * 1/2007 ..... A45B 9/02
JP 2008086610 A * 4/2008 ..... A45B 9/00
JP 2009268655 A * 11/2009 ..... A61H 3/00

*Primary Examiner* — Winnie Yip
(74) *Attorney, Agent, or Firm* — C. G. Mersereau; Nikolai & Mersereau, P.A.

(57) ABSTRACT

A forearm crutch has a cane assembly including a main cane and a hand grip mounted on the main cane, an adjustable base slidably mounted on the main cane, a forearm support assembly including a forearm support cane securely attached to the adjustable base and a cuff mounted on the forearm support cane, and a first locking assembly selectively locks the adjustable base in place on the main cane. When the first locking assembly is unlocked, the adjustable base and the forearm support assembly can slide along the main cane. By sliding the adjustable base and the forearm support assembly downward, the forearm crutch can be shortened and occupy small room, so as to be suitable for storage.

10 Claims, 10 Drawing Sheets

(56) References Cited

U.S. PATENT DOCUMENTS

| | | | | |
|---|---|---|---|---|
| 7,503,337 | B1 * | 3/2009 | Morgan | A61H 3/02 135/70 |
| 7,621,288 | B2 * | 11/2009 | Evans | A45B 9/02 135/68 |
| D697,300 | S * | 1/2014 | Alsaffar | D3/7 |
| 9,192,213 | B2 * | 11/2015 | Lin | A45B 9/00 |
| 9,198,822 | B1 * | 12/2015 | Hao | A61H 3/02 |
| 2003/0098052 | A1 * | 5/2003 | Fismer | A45B 5/00 135/76 |
| 2014/0053887 | A1 * | 2/2014 | Lee | A45B 9/04 135/66 |
| 2016/0151229 | A1 * | 6/2016 | Varghese | A61H 3/02 135/71 |

* cited by examiner

FOREARM CRUTCH

BACKGROUND OF THE INVENTION

1. Field of the Invention

The present invention relates to a mobility aid, especially to a forearm crutch.

2. Description of the Prior Art(s)

A crutch is a common mobility aid and basically includes a stick made of wood or metal. The crutch is also an important medical auxiliary equipment used in rehabilitation and may be a cane, a forearm crutch, an axillary crutch, and so forth. The forearm crutch has advantages of providing support for patients, reducing burden on a wounded limb, and improving walking stability, and therefore assists the patients in walking.

However, a conventional forearm crutch has a long and unadjustable length. Thus, it is inconvenient in storing the conventional forearm crutch when the conventional forearm crutch is not in use.

To overcome the shortcomings, the present invention provides a forearm crutch to mitigate or obviate the aforementioned problems.

SUMMARY OF THE INVENTION

The main objective of the present invention is to provide a forearm crutch. The forearm crutch has a cane assembly including a main cane and a hand grip mounted on the main cane, an adjustable base slidably mounted on the main cane, a forearm support assembly including a forearm support cane securely attached to the adjustable base and a cuff mounted on the forearm support cane, and a first locking assembly selectively locks the adjustable base in place on the main cane.

When the first locking assembly is unlocked, the adjustable base and the forearm support assembly can slide along the main cane. By sliding the adjustable base and the forearm support assembly downward, the forearm crutch can be shortened and occupy small room, so as to be suitable for storage.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
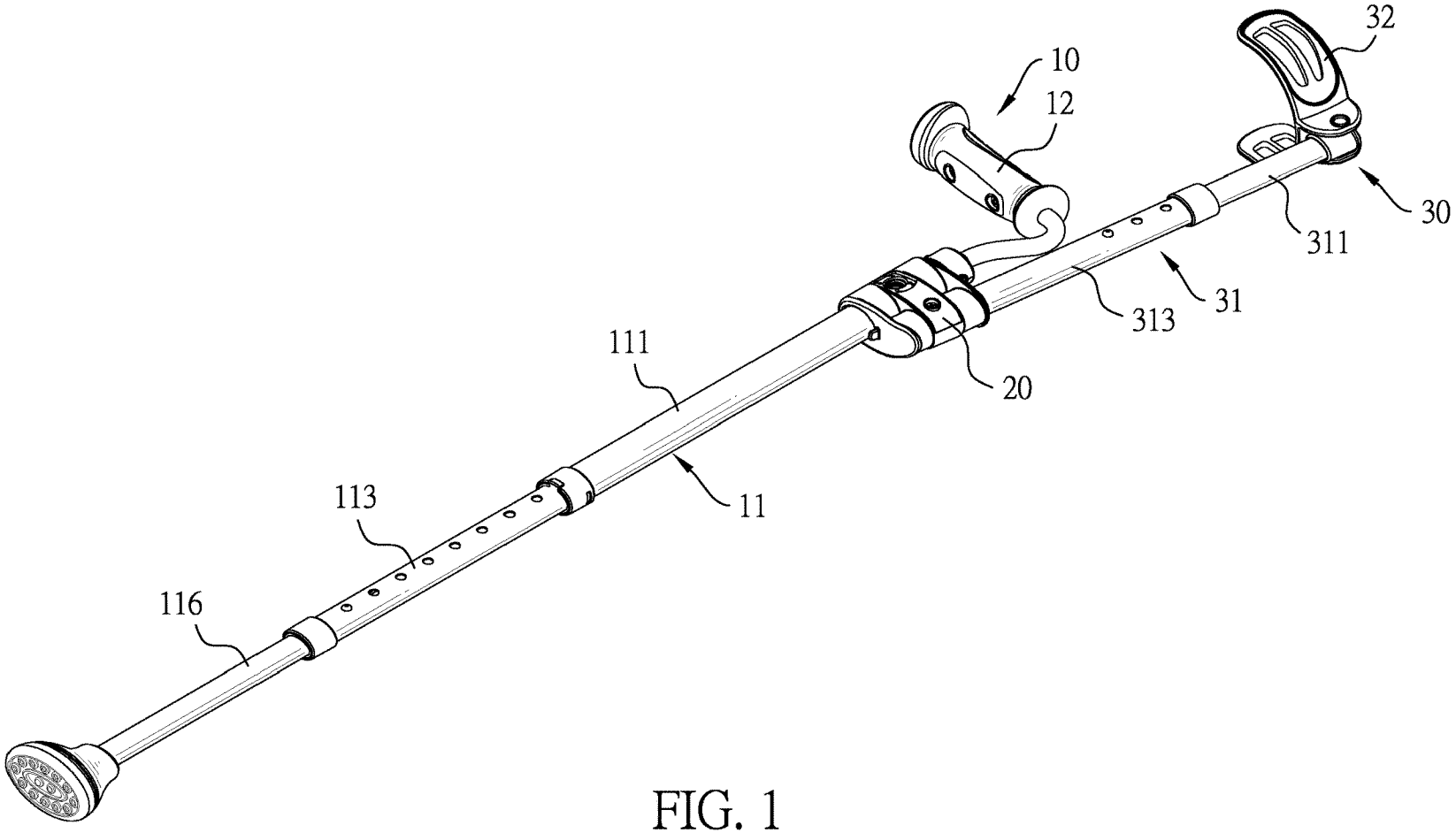
FIG. 1 is a perspective view of a forearm crutch in accordance with the present invention.

With reference to FIGS. 1, 2, 9, and 10, a forearm crutch in accordance with the present invention comprises a cane assembly 10, an adjustable base 20, a forearm support assembly 30, and a first locking assembly 40.

The cane assembly 10 includes a main cane 11 and a hand grip 12. The main cane 11 is telescopic and has an upper end. The hand grip 12 is mounted on the upper end of the main cane 11.

Figure 6:
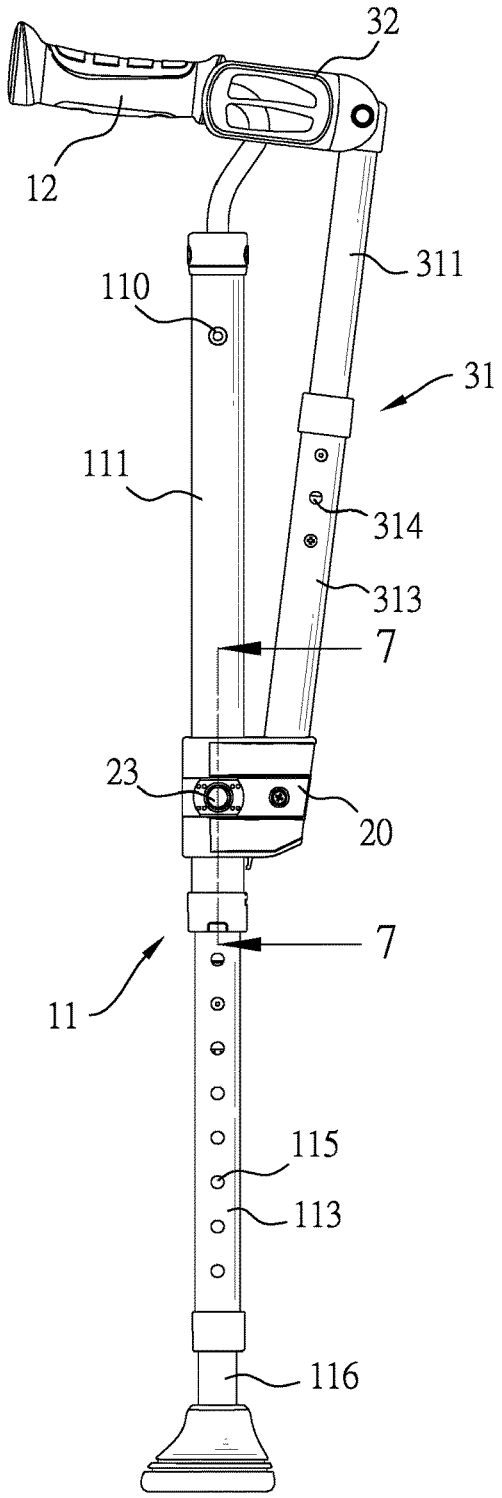
FIG. 6 is a side view of the forearm crutch in FIG. 1, showing a cane assembly being partially retracted, and an adjustable base and a forearm support assembly sliding upward.
Figure 7:
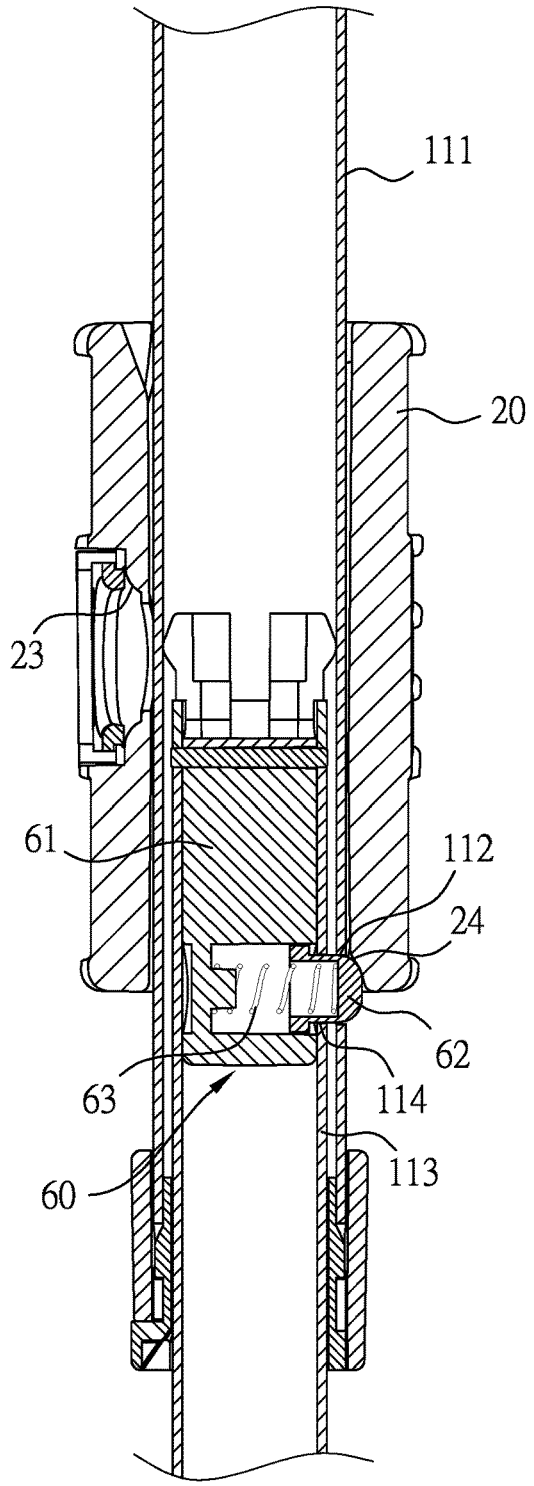
FIG. 7 is a cross-sectional side view of the forearm crutch along line 7-7 in FIG. 6.
Figure 8:
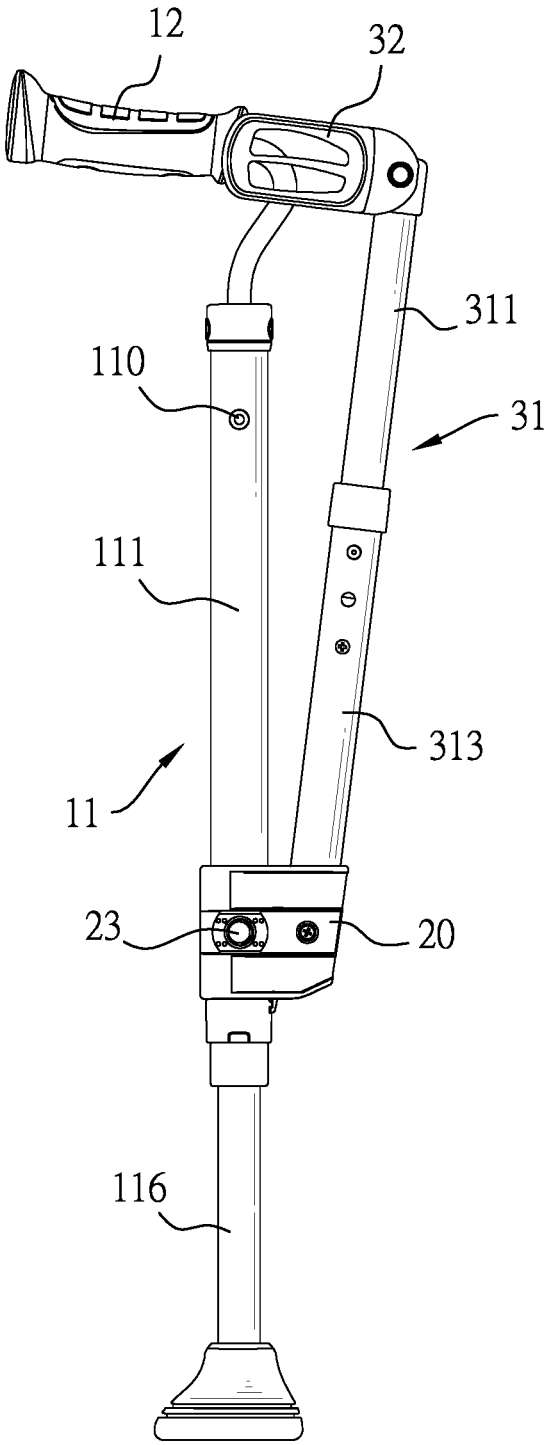
FIG. 8 is a side view of the forearm crutch in FIG. 1, showing the adjustable base and the forearm support assembly sliding downward, and the cane assembly being retracting.
Figure 9:
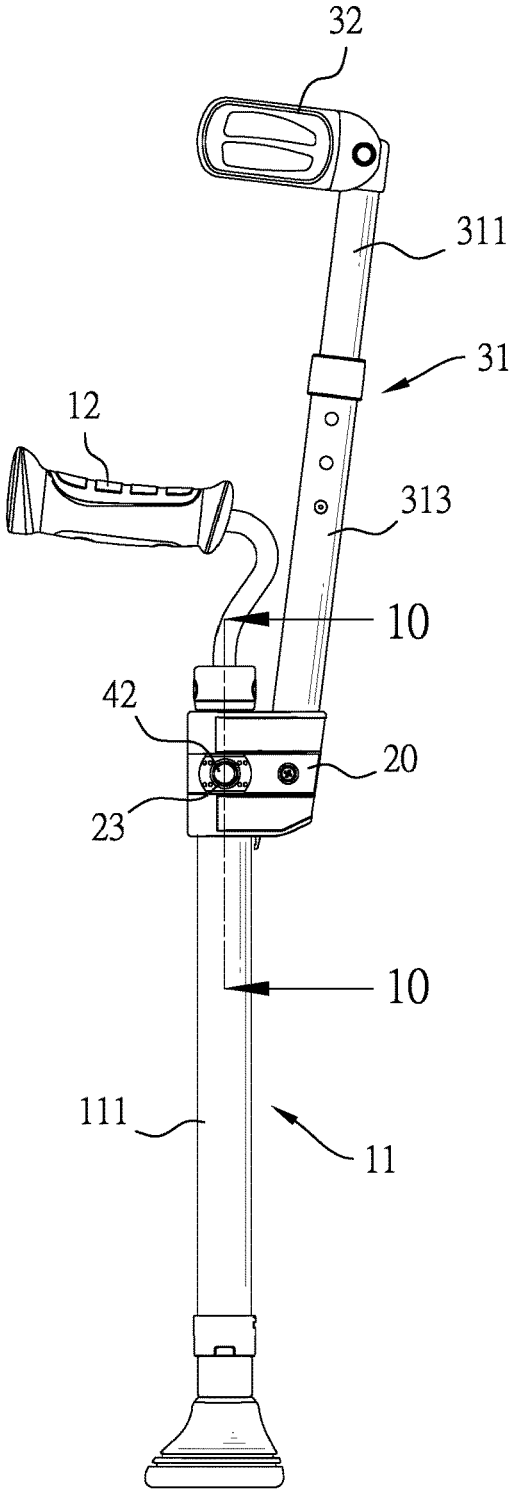
FIG. 9 is a side view of the forearm crutch in FIG. 1, showing the cane assembly being fully retracted, and the adjustable base and the forearm support assembly sliding upward.

With further reference to FIGS. 6 and 7, the adjustable base 20 is slidably mounted on the main cane 11 and has an upper end surface, a lower end surface, a main mounting channel 21, and an additional mounting channel 22. The main mounting channel 21 extends between and is formed through the upper end surface and the lower end surface of the adjustable base 20, and is mounted around the main cane 11. The additional mounting channel 22 is formed in the upper end surface of the adjustable base 20, obliquely extends relative to the main mounting channel 21, and is independent from the main mounting channel 21.

The forearm support assembly 30 is used for supporting a forearm of a user, so as to provide support for the user, reduce burden on a wounded limb, and improve walking stability. The forearm support assembly 30 includes a forearm support cane 31 and a cuff 32. The forearm support cane 31 is telescopic and has an upper end and a lower end. The lower end of the forearm support cane 31 is mounted in the additional mounting channel 22 of the adjustable base 20 and is securely attached to the adjustable base 20. The cuff 32 is mounted on the upper end of the forearm support cane 31.

The first locking assembly 40 selectively locks the adjustable base 20 in place on the main cane 11.

Figure 3:
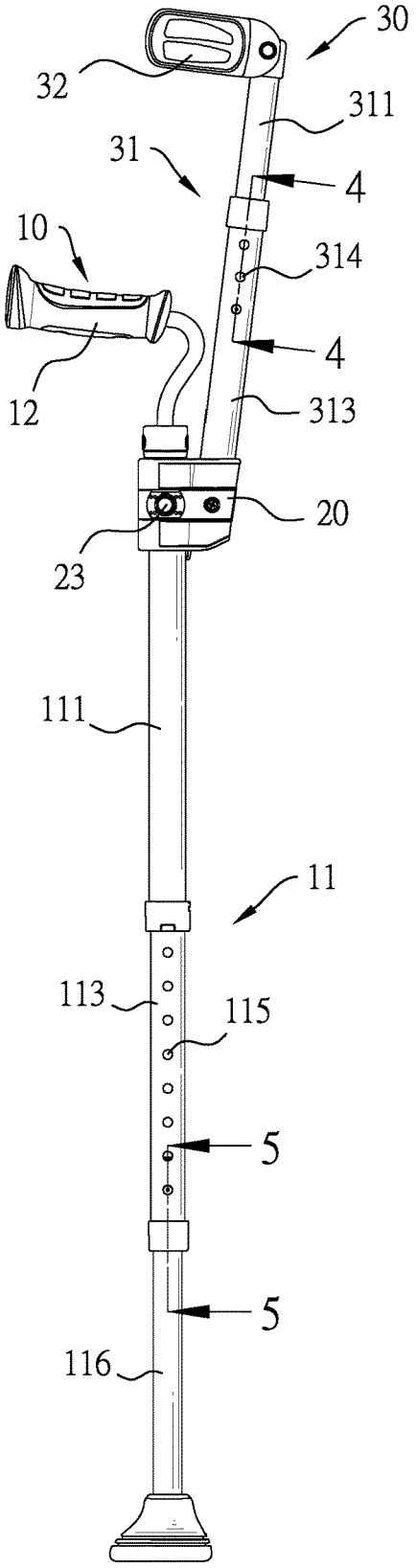
FIG. 3 is a side view of the forearm crutch in FIG. 1.

With reference to FIGS. 3 and 6, the forearm support assembly 30 together with the adjustable base 20 can slide along the main cane 11 of the cane assembly 10. As shown in FIG. 3, when using the forearm crutch, the adjustable base 20 slides upward along the main cane 11, the forearm support assembly 30 upwardly protrudes from the cane assembly 10, and then the first locking assembly 40 locks the adjustable base 20 in place. Thus, a relative of the forearm support assembly 30 and the cane assembly 10 is locked and the extended forearm crutch can be used to provide support to the user.

As shown in FIG. 6, when storing the forearm crutch, the first locking assembly 40 is unlocked, such that the adjustable base 20 and the forearm support assembly 30 can slide along the main cane 11. By sliding the adjustable base 20 and the forearm support assembly 30 downward, the forearm crutch can be shortened and occupy small room, so as to be suitable for storage.

Figure 10:
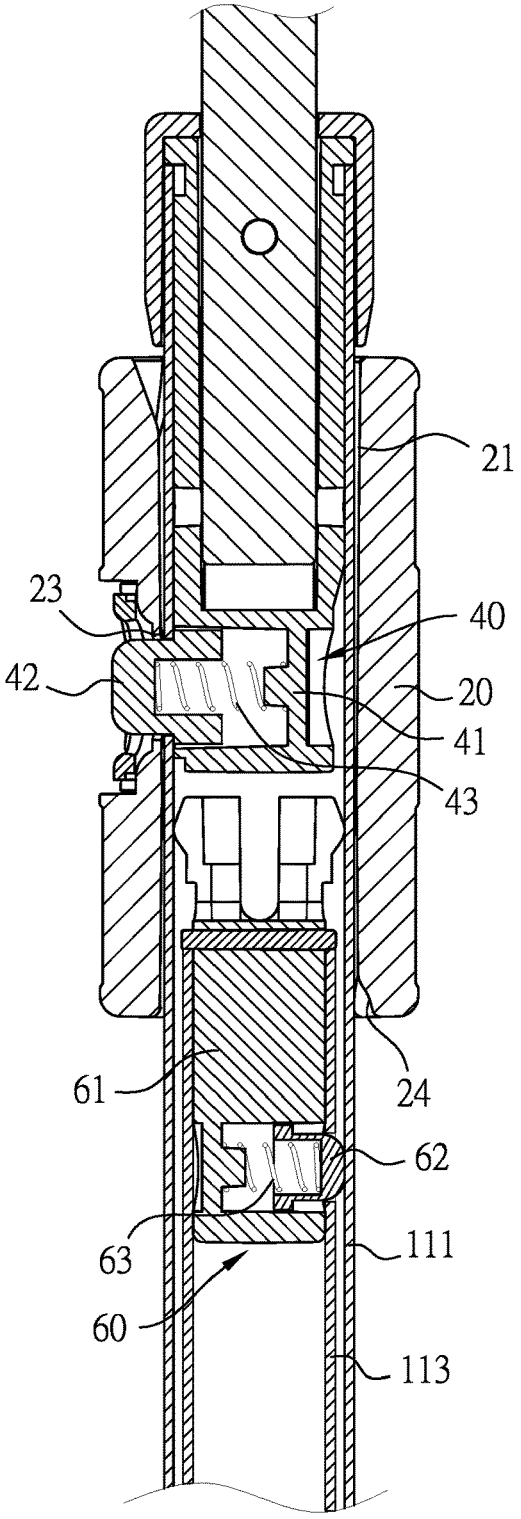
FIG. 10 is a cross-sectional side view of the forearm crutch along line 10-10 in FIG. 9.

As shown in FIG. 10, specifically, the main cane 11 is hollow and has a sidewall and a first through hole 110. The first through hole 110 is formed through the sidewall of the main cane 11 and is disposed adjacent to the upper end of the main cane 11.

The adjustable base 20 has a sidewall and a first locking hole 23. The first locking hole 23 is formed through the sidewall of the adjustable base 20 and communicates with the main mounting channel 21.

The first locking mechanism 40 is mounted in the main cane 11, is disposed adjacent to the upper end of the main cane 11, and includes a first mounting seat 41, a first locking button 42, and a first resilient element 43. The first mounting seat 41 is securely mounted in the main cane 11 and corresponds in position to the first through hole 110. The first locking button 42 is mounted on the first mounting seat 41, is mounted through the first through hole 110, and has an outer end. The first resilient element 43 is mounted in the first mounting seat 41 and has two ends respectively abutting against the first mounting seat 41 and the first locking button 42, such that the first locking button 42 is resiliently mounted through the first through hole 110 on the sidewall of the main cane 11.

When the outer end of the first locking button 42 engages in the first locking hole 23 of the adjustable base 20, the adjustable base 20 is locked in place on the main cane 11. When the outer end of the first locking button 42 is pressed to disengage from the first locking hole 23, the adjustable base 20 is slidable on the main cane 11.

Figure 2:
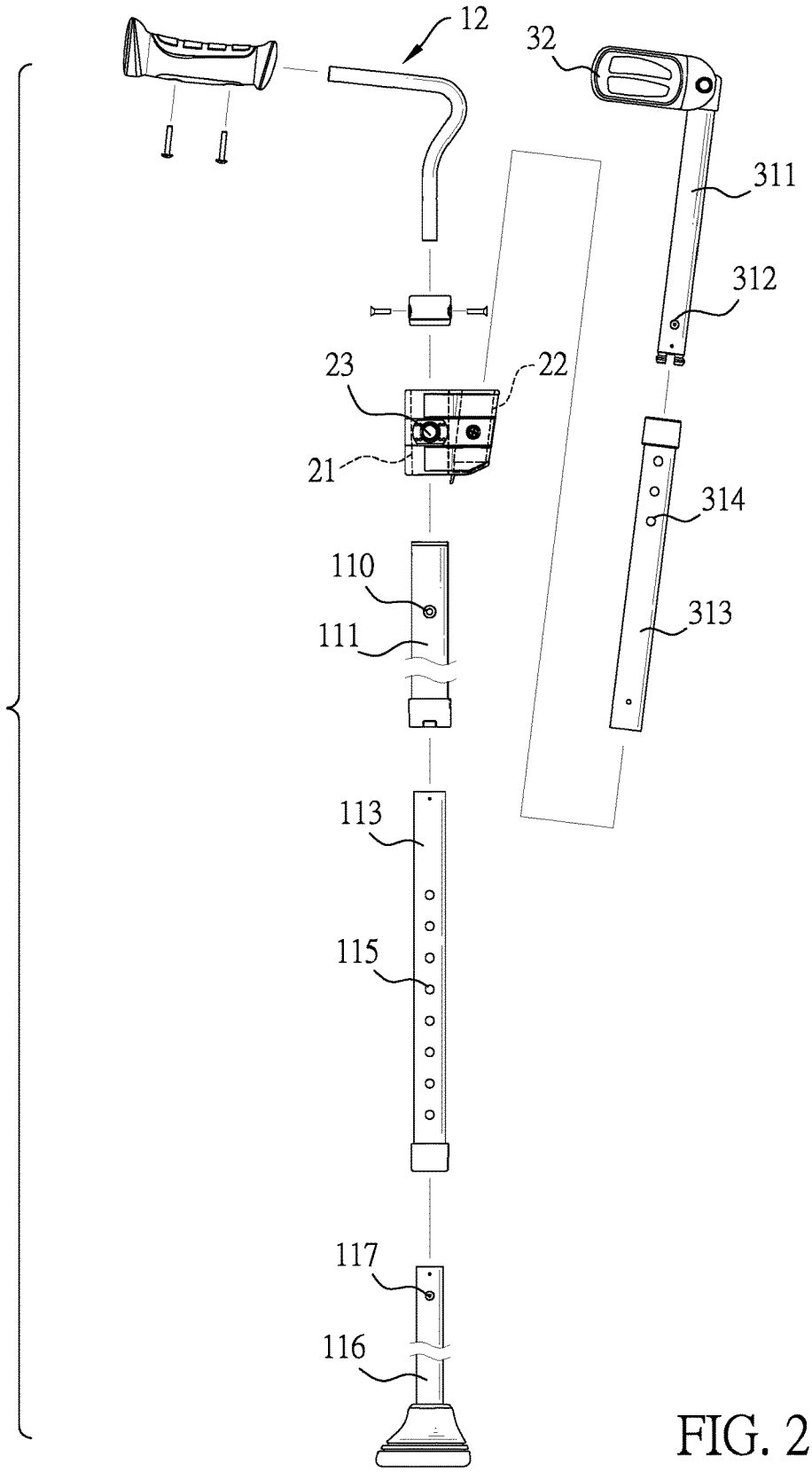
FIG. 2 is an exploded side view of the forearm crutch in FIG. 1.
Figure 4:
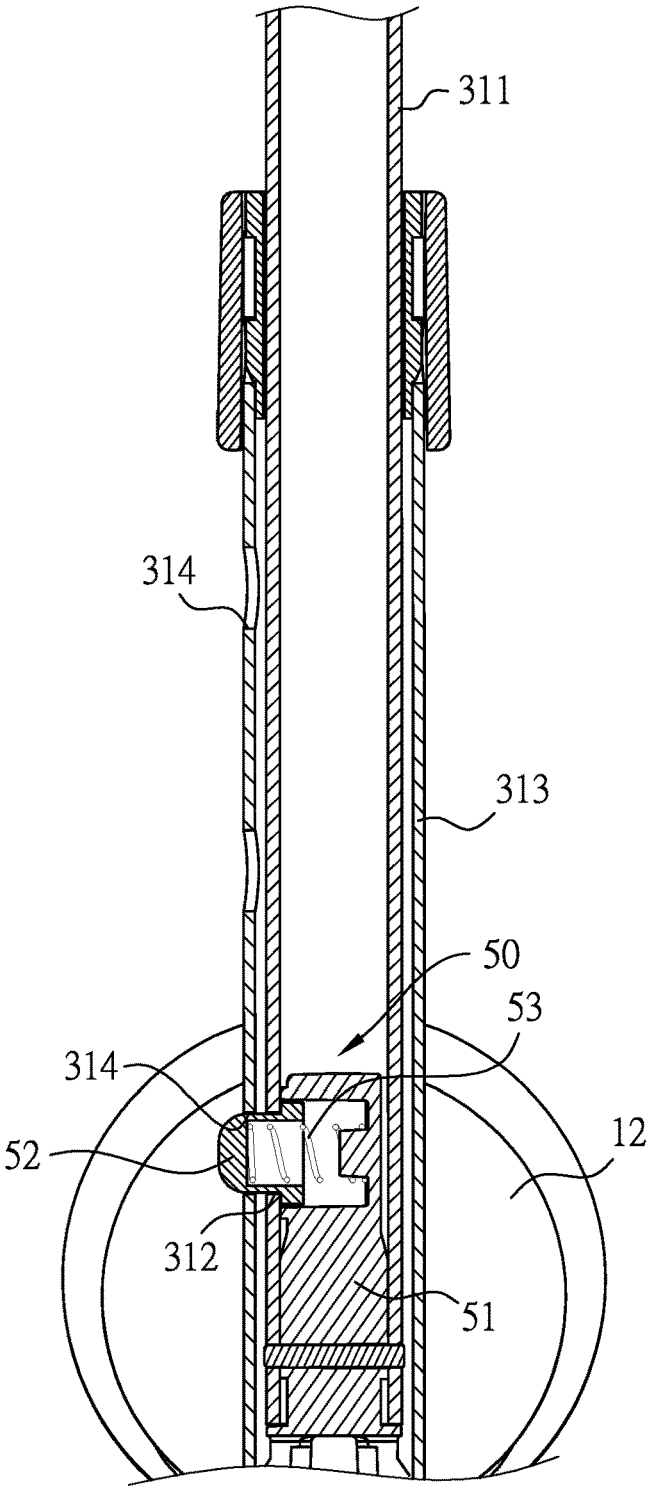
FIG. 4 is a cross-sectional side view of the forearm crutch along line 4-4 in FIG. 3.
Figure 5:
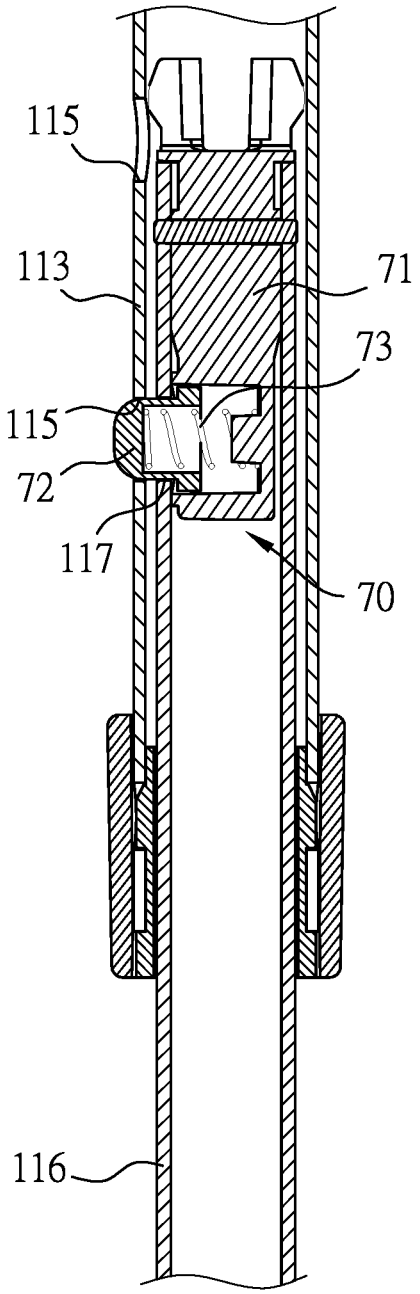
FIG. 5 is a cross-sectional side view of the forearm crutch along line 5-5 in FIG. 3.

With reference to FIGS. 2 to 4, in the preferred embodiment, the forearm support cane 31 includes a first forearm support tube 311, a second forearm support tube 313, and a second locking mechanism 50. The second forearm support tube 313 is telescopically connected to the first forearm support tube 311 and is securely mounted in the additional mounting channel 22 of the adjustable base 20. The second locking mechanism 50 selectively locks the first forearm support tube 311 in position on the second forearm support tube 313. Since the first and second forearm support tubes 311, 313 are telescopically connected to each other, a length of the forearm support cane 31 can be adjusted, so as to allow the forearm crutch to fit for different users with different heights.

Specifically, the first forearm support tube 311 has a sidewall and a second through hole 312. The second through hole 312 is formed through the sidewall of the first forearm support tube 311.

The second forearm support tube 313 is mounted around the first forearm support tube 311, and has two opposite ends and multiple first positioning holes 314. The first positioning holes 314 are arranged linearly between the opposite ends of the second forearm support tube 313.

The second locking mechanism 50 is mounted in the first forearm support tube 311 and includes a second mounting seat 51, a second locking button 52, and a first resilient element 53. The second mounting seat 51 is securely mounted in the first forearm support tube 311 and corresponds in position to the second through hole 312. The second locking button 52 is mounted on the second mounting seat 51, is mounted through the second through hole 312, and has an outer end. The first resilient element 53 is mounted in the second mounting seat 51 and has two ends respectively abutting against the second mounting seat 51 and the second locking button 52, such that the second locking button 52 is resiliently mounted through the second through hole 312 on the sidewall of the first forearm support tube 311.

When the outer end of the second locking button 52 engages in one of the first positioning holes 314 of the second forearm support tube 313, the first forearm support tube 311 is locked in place on the second forearm support tube 313. When the outer end of the second locking button 52 is pressed to disengage from the first positioning hole 314, the first forearm support tube 311 is slidable on the second forearm support tube 313.

With reference to FIGS. 6 and 7, in the preferred embodiment, the main cane 11 includes a first mounting tube 111, a second mounting tube 113, and a third locking mechanism 60. The first mounting tube 111 is mounted through the main mounting channel 21 of the adjustable base 20. The second mounting tube 113 is telescopically connected to the first mounting tube 111. The second locking mechanism 60 selectively locks the first mounting tube 111 in position on the second mounting tube 113.

As shown in FIG. 6, since the first and second mounting tubes 111, 113 are telescopically connected to each other, the first and second mounting tube 111, 113 can slide relative to each other when the third locking assembly 60 is unlocked. Thus, a length of the main cane 11 can be shortened to allow the forearm crutch to occupy small room and be suitable for storage.

Specifically, the first mounting tube 111 is mounted around the second mounting tube 113, and has a sidewall and a second locking hole 112. The second locking hole 112 is formed through the sidewall of the first mounting tube 111. The second mounting tube 113 has a sidewall and a third through hole 114. The third through hole 114 is formed through the sidewall of the second mounting tube 113.

The third locking mechanism 60 is mounted in the second mounting tube 113 and includes a third mounting seat 61, a third locking button 62, and a third resilient element 63. The third mounting seat 61 is securely mounted in the second mounting tube 113 and corresponds in position to the third through hole 114. The third locking button 62 is mounted on the third mounting seat 61, is mounted through the third through hole 114, and has an outer end. The third resilient element 63 is mounted in the third mounting seat 61 and has two ends respectively abutting against the third mounting seat 61 and the third locking button 62, such that the third locking button 62 is resiliently, mounted through the third through hole 114 on the sidewall of the second mounting tube 113.

When the outer end of the third locking button 62 engages in the second locking hole 112 of the first mounting tube 111, the second mounting tube 113 is locked in place on the first mounting tube 111. When the outer end of the third locking button 62 is pressed to disengage from the second locking hole 112, the second mounting tube 113 is slidable on the first mounting tube 111, so as to shorten the length of the main cane 11.

Preferably, as shown in FIG. 7, the adjustable base 20 has a hole edge and an inclined surface 24. The hole edge is formed on the lower end surface of the adjustable base 20 and is defined around the main mounting channel 21. The inclined surface 24 is formed on the hole edge of the adjustable base 20.

When the first locking mechanism 40 is unlocked, the adjustable base 20 is able to slide along the first mounting tube 111. As the adjustable base 20 toward an end of the first mounting tube 111, the inclined surface 24 of the adjustable base 20 abuts and presses the third locking button 63 to cause the third locking button 62 to disengage from the second locking hole 112 of the first mounting tube 111. Thus, the second mounting tube 113 is slidable on the first mounting tube 111, so as to shorten the length of the main cane 11.

Since the user unlocks the first locking mechanism 40 and then the third locking mechanism 60 is unlocked accordingly, it is convenient for the user to fold the forearm crutch.

Furthermore, with further reference to FIGS. 3, 5, 8, and 9, in the preferred embodiment, the main cane 11 further includes a third mounting tube 116 and a fourth locking mechanism 70. The third mounting tube 116 is telescopically connected to the second mounting tube 113. The fourth locking mechanism 70 selectively locks the third mounting tube 116 in position on the second mounting tube 113. Since the second and third mounting tubes 113, 116 are telescopically connected to each other, the length of the main cane 11 can be further adjusted, so as to allow the forearm crutch to fit for the different users with the different heights.

Specifically, the third mounting tube 116 has a sidewall and a fourth through hole 117. The fourth through hole 117 is formed through the sidewall of the third mounting tube 116. The second mounting tube 113 is mounted around the third mounting tube 116, and has two opposite ends and multiple second positioning holes 115. The second positioning holes 115 are arranged linearly between the opposite ends of the second mounting tube 113.

The fourth locking mechanism 70 is mounted in the third mounting tube 116 and includes a fourth mounting seat 71, a fourth locking button 72, and a fourth resilient element 73. The fourth mounting seat 71 is securely mounted in the third mounting tube 116 and corresponds in position to the fourth through hole 117. The fourth locking button 72 is mounted on the fourth mounting seat 71, is mounted through the fourth through hole 117, and has an outer end. The fourth resilient element 73 is mounted in the fourth mounting seat 71 and has two ends respectively abutting against the fourth mounting seat 71 and the fourth locking button 72, such that the fourth locking button 72 is resiliently mounted through the fourth through hole 117 on the sidewall of the third mounting tube 116.

When the outer end of the fourth locking button 72 engages in one of the second positioning holes 115 of the second mounting tube 113, the third mounting tube 116 is locked in place on the second mounting tube 113. When the outer end of the fourth locking button 72 is pressed to disengage from the second positioning hole 115, the third mounting tube 116 is slidable on the second mounting tube 113. By engaging the fourth locking button 72 in the other second positioning holes 115 of the second mounting tube 113, the length of the main cane 11 can be adjusted, so as to allow the forearm crutch to fit for the different users with the different heights.

The forearm crutch as described has the following advantages. The main cane 11 that is telescopic can be retracted to a compact length and the forearm support assembly 30 can slide downward to allow the forearm support assembly 30 to be disposed beside the cane assembly 10. Thus, the forearm crutch that is shortened occupies small room and is suitable for storage. Moreover, since the lengths of the main cane 11 and the forearm support cane 31 can be adjusted, a length of the forearm crutch can adjusted to fit for the different users with the different heights.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A forearm crutch comprising:

a cane assembly including a main cane having an upper end; and a hand grip mounted on the upper end of the main cane;

an adjustable base slidably mounted on the main cane and having a main mounting channel mounted around the main cane;

an additional mounting channel obliquely extending relative to the main mounting channel, and being independent from the main mounting channel; and a first locking hole formed through a sidewall of the adjustable base and communicating with the main mounting channel;

a forearm support assembly including a forearm support cane having an upper end; and a lower end mounted in the additional mounting channel of the adjustable base and securely attached to the adjustable base; and a cuff mounted on the upper end of the forearm support cane; and a first locking assembly mounted in the main cane, selectively locking the adjustable base in place on the main cane, and including a first locking button, and the first locking button resiliently mounted through a sidewall of the main cane and has an outer end;

wherein when the outer end of the first locking button engages in the first locking hole of the adjustable base, the adjustable base is locked in place on the main cane; and when the outer end of the first locking button is pressed to disengage from the first locking hole, the adjustable base is slidable on the main cane.

2. The forearm crutch as claimed in claim 1, wherein the main cane is telescopic.

3. The forearm crutch as claimed in claim 2, wherein the forearm support cane is telescopic.

4. The forearm crutch as claimed in claim 1, wherein the forearm support cane includes a first forearm support tube;

a second forearm support tube telescopically connected to the first forearm support tube and securely mounted in the additional mounting channel of the adjustable base; and a second locking mechanism selectively locking the first forearm support tube in position on the second forearm support tube.

5. The forearm crutch as claimed in claim 4, wherein the second forearm support tube is mounted around the first forearm support tube, and has two opposite ends; and multiple first positioning holes arranged linearly between the opposite ends of the second forearm support tube;

the second locking mechanism is mounted in the first forearm support tube and includes a second locking button, and the second locking button is resiliently mounted through a sidewall of the first forearm support tube and has an outer end;

wherein when the outer end of the second locking button engages in one of the first positioning holes of the second forearm support tube, the first forearm support tube is locked in place on the second forearm support tube; and when the outer end of the second locking button is pressed to disengage from the first positioning hole, the first forearm support tube is slidable on the second forearm support tube.

6. The forearm crutch as claimed in claim 1, wherein the main cane includes a first mounting tube mounted through the main mounting channel of the adjustable base;

a second mounting tube telescopically connected to the first mounting tube; and a third locking mechanism selectively locking the first mounting tube in position on the second mounting tube.

7. The forearm crutch as claimed in claim 6, wherein the first mounting tube is mounted around the second mounting tube, and has a second locking hole formed through a sidewall of the first mounting tube; and the third locking mechanism is mounted in the second mounting tube and includes a third locking button, and the third locking button is resiliently mounted through a sidewall of the second mounting tube and has an outer end;

wherein when the outer end of the third locking button engages in the second locking hole of the first mounting tube, the second mounting tube is locked in place on the first mounting tube; and when the outer end of the third locking button is pressed to disengage from the second locking hole, the second mounting tube is slidable on the first mounting tube.

8. The forearm crutch as claimed in claim 6, wherein the main cane further includes a third mounting tube telescopically connected to the second mounting tube; and a fourth locking mechanism selectively locking the third mounting tube in position on the second mounting tube.

9. The forearm crutch as claimed in claim 8, wherein the second mounting tube is mounted around the third mounting tube, and has two opposite ends; and multiple second positioning holes arranged linearly between the opposite ends of the second mounting tube;

the fourth locking mechanism is mounted in the third mounting tube and includes a fourth locking button, and the fourth locking button is resiliently mounted through a sidewall of the third mounting tube and has an outer end;

wherein when the outer end of the fourth locking button engages in one of the second positioning holes of the second mounting tube, the third mounting tube is locked in place on the second mounting tube; and when the outer end of the fourth locking button is pressed to disengage from the second positioning hole, the third mounting tube is slidable on the second mounting tube.

10. The forearm crutch as claimed in claim 9, wherein the third mounting tube has a through hole formed through the sidewall of the third mounting tube;

the fourth locking button is resiliently mounted through the through hole of the third mounting tube; and the outer end of the fourth locking button selectively engages in one of the second positioning holes of the second mounting tube.

* * * * *